US009767759B2

(12) United States Patent
Shin et al.

(10) Patent No.: US 9,767,759 B2
(45) Date of Patent: Sep. 19, 2017

(54) GATE DRIVER, DISPLAY APPARATUS INCLUDING THE SAME AND METHOD OF DRIVING DISPLAY PANEL USING THE SAME

(71) Applicant: Samsung Display Co., LTD., Yongin, Gyeonggi-Do (KR)

(72) Inventors: Yong-Jin Shin, Asan-si (KR); Jun-Ho Hwang, Asan-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 159 days.

(21) Appl. No.: 14/510,391

(22) Filed: Oct. 9, 2014

(65) Prior Publication Data

US 2015/0116386 A1 Apr. 30, 2015

(30) Foreign Application Priority Data

Oct. 31, 2013 (KR) ..... 10-2013-0131715

(51) Int. Cl.
*G09G 3/36* (2006.01)

(52) U.S. Cl.
CPC ..... *G09G 3/3688* (2013.01); *G09G 3/3614* (2013.01); *G09G 2310/0251* (2013.01); *G09G 2310/06* (2013.01); *G09G 2320/02* (2013.01)

(58) Field of Classification Search
CPC ..... G09G 3/3688; G09G 3/3614; G09G 2320/02; G09G 2310/0251; G09G 2310/06
See application file for complete search history.

(56) References Cited

U.S. PATENT DOCUMENTS 6,211,851 B1 * 4/2001 Lien ..... G09G 3/3648 345/58
6,924,784 B1 8/2005 Yeo et al.
7,486,264 B2 * 2/2009 Taguchi ..... G02F 1/13306 345/100
7,683,870 B2 3/2010 Kang et al.
2002/0084971 A1 * 7/2002 Youn ..... G09G 3/3648 345/99
2002/0149553 A1 * 10/2002 Tsujimura ..... G09G 3/3648 345/92
2003/0016189 A1 * 1/2003 Abe ..... G09G 3/20 345/55
2003/0038766 A1 * 2/2003 Lee ..... G09G 3/3648 345/87
2004/0041760 A1 3/2004 Tsumura et al.
2005/0001802 A1 * 1/2005 Lee ..... G09G 3/3648 345/89
2005/0169075 A1 8/2005 Park
(Continued)

FOREIGN PATENT DOCUMENTS

KR 1020090012650 A 4/2009
KR 1020100048420 A 5/2010
(Continued)

*Primary Examiner* — Ilana Spar
*Assistant Examiner* — Mihir K Rayan
(74) *Attorney, Agent, or Firm* — Cantor Colburn LLP

(57) ABSTRACT

A gate driver includes a precharge signal generating part configured to generate a precharge signal which varies based on a previous data signal corresponding to a previous gate line and a data signal corresponding to a gate line, and a signal adding part configured to add the precharge signal and a non-precharge signal to generate a gate signal.

12 Claims, 9 Drawing Sheets

(56) References Cited

U.S. PATENT DOCUMENTS

| | | | | |
|---|---|---|---|---|
| 2005/0195671 | A1* | 9/2005 | Taguchi | G02F 1/13306 365/203 |
| 2006/0119559 | A1* | 6/2006 | Jung | G09G 3/3614 345/96 |
| 2006/0176265 | A1* | 8/2006 | Kim | G09G 3/3648 345/100 |
| 2006/0290644 | A1* | 12/2006 | Kim | G09G 3/3677 345/100 |
| 2007/0046609 | A1* | 3/2007 | Lee | G09G 3/3648 345/94 |
| 2007/0236426 | A1* | 10/2007 | Chu | G09G 3/3216 345/77 |
| 2008/0001865 | A1 | 1/2008 | Kim et al. | |
| 2008/0180372 | A1* | 7/2008 | Kim | G09G 3/3677 345/87 |

FOREIGN PATENT DOCUMENTS

| | | | |
|---|---|---|---|
| KR | 1020110075413 | A | 7/2011 |
| KR | 1020110076642 | A | 7/2011 |

* cited by examiner

GATE DRIVER, DISPLAY APPARATUS INCLUDING THE SAME AND METHOD OF DRIVING DISPLAY PANEL USING THE SAME

This application claims priority to Korean Patent Application No. 10-2013-0131715, filed on Oct. 31, 2013, and all the benefits accruing therefrom under 35 U.S.C. §119, the contents of which in its entirety is herein incorporated by reference.

BACKGROUND

1. Field

Exemplary embodiments of the invention relate to a gate driver, a display apparatus including the gate driver and a method of driving a display panel using the gate driver. More particularly, exemplary embodiments of the invention relate to a gate driver that improves display quality of a display apparatus, a display apparatus including the gate driver and a method of driving a display panel using the gate driver.

2. Description of the Related Art

Generally, a liquid crystal display ("LCD") apparatus includes a first substrate including a pixel electrode, a second substrate including a common electrode and a liquid crystal layer disposed between the first and second substrate. An electric field is generated by voltages applied to the pixel electrode and the common electrode. By adjusting an intensity of the electric field, a transmittance of a light passing through the liquid crystal layer may be adjusted to display a desired image.

Generally, a display apparatus includes a display panel and a panel driver. The display panel includes a plurality of gate lines, a plurality of data lines and a plurality of pixels connected to the gate lines and the data lines. The panel driver includes a gate driver providing gate signals to the gate lines and a data driver providing data voltages to the data lines.

To improve a charging rate of the pixel, a precharge driving method has been developed. In the precharge driving method, an N-th gate line may be activated before an N-th horizontal period.

SUMMARY

In a display panel, when precharging is excessive in the precharge driving method, the pixel may be overcharged such that the pixel may represent a luminance higher than a desired grayscale. Thus, a ghost defect may occur at the pixel.

Exemplary embodiments of the invention provide a gate driver that effectively prevents a ghost defect to improve display quality of a display panel.

Exemplary embodiments of the invention also provide a display apparatus including the gate driver.

Exemplary embodiments of the invention also provide a method of driving the display panel using the gate driver.

In an exemplary embodiment of a gate driver according to the invention, the gate driver includes a precharge signal generating part and a signal adding part. In such an embodiment, the precharge signal generating part is configured to generate a precharge signal which varies based on a previous data signal corresponding to a previous gate line and a present data signal corresponding to a present gate line, and the signal adding part is configured to add the precharge signal and a non-precharge signal to generate a gate signal.

In an exemplary embodiment, the precharge signal may be determined by a difference between the present data signal and the previous data signal.

In an exemplary embodiment, a width of a high duration of the precharge signal may vary based on the difference between the present data signal and the previous data signal.

In an exemplary embodiment, the width of the high duration of the precharge signal may increase as the difference between a value of the present data signal and a value of the previous data signal increases.

In an exemplary embodiment, the precharge signal may have no high duration when the value of the present data signal is less than the value of the previous data signal.

In an exemplary embodiment, the precharge signal may have no high duration when the value of the present data signal is equal to or less than the value of the previous data signal.

In an exemplary embodiment, the value of the previous data signal may be an average of grayscale data of pixels corresponding to the previous gate line, and the value of the present data signal may be an average of grayscale data of pixels corresponding to the present gate line.

In an exemplary embodiment, the gate driver may further include a memory configured to store the previous data signal.

In an exemplary embodiment, the signal adding part may be configured to operate an OR operation between the precharge signal and the non-precharge signal.

In an exemplary embodiment, the previous data signal may correspond to an (N−1)-th gate line, the present data signal may correspond to an N-th gate line, a high duration of the precharge signal may be defined in an (N−1)-th horizontal period, and a high duration of the non-precharge signal may be defined in an N-th horizontal period, where N is a positive integer.

In an exemplary embodiment, a data signal corresponding to the (N−1)-th gate line may have a polarity the same as a polarity of a data signal corresponding to the N-th gate line.

In an exemplary embodiment, the previous data signal may correspond to an (N−2)-th gate line, the present data signal may correspond to an N-th gate line, a high duration of the precharge signal may be defined in an (N−2)-th horizontal period, and a high duration of the non-precharge signal may be defined in an N-th horizontal period, where N is a positive integer.

In an exemplary embodiment, a data signal corresponding to the (N−2)-th gate line may have a polarity the same as a polarity of a data signal corresponding to the N-th gate line, and a data signal corresponding to an (N−1)-th gate line may have a polarity opposite to the polarity of the data signal corresponding to the N-th gate line In an exemplary embodiment of a display apparatus according to the invention, the display apparatus includes a display panel, a gate driver and a data driver. In such an embodiment, the display panel is configured to display an image, the gate driver is configured to output a gate signal to the display panel, where the gate driver includes a precharge signal generating part configured to generate a precharge signal which varies based on a previous data signal corresponding to a previous gate line and a present data signal corresponding to a present gate line and a signal adding part configured to add the precharge signal and a non-precharge signal to generate the gate signal, and the data driver is configured to generate a data voltage and to output the data voltage to the display panel.

In an exemplary embodiment, the precharge signal may be determined by a difference between the present data signal and the previous data signal.

In an exemplary embodiment, a width of a high duration of the precharge signal may vary based on the difference between the present data signal and the previous data signal.

In an exemplary embodiment of a method of driving a display panel according to the invention, the method includes generating a precharge signal which varies based on a previous data signal corresponding to a previous gate line and a present data signal corresponding to a present gate line and adding the precharge signal and a non-precharge signal to generate a gate signal.

In an exemplary embodiment, the precharge signal may be determined by a difference between the present data signal and the previous data signal.

In an exemplary embodiment, a width of a high duration of the precharge signal may vary based on the difference between the present data signal and the previous data signal.

According to exemplary embodiments of the gate driver, the display apparatus having the gate driver and the method of driving the display panel using the gate driver, a precharge signal which varies based on a previous data signal and a present data signal is generated such that a precharge may be properly operated according to a grayscale of a pixel. Thus, a charging rate of the pixel may be effectively compensated by the precharge driving method and the ghost defect due to the precharge driving method may be effectively prevented such that the display quality of the display panel may be improved.

BRIEF DESCRIPTION OF THE DRAWINGS

The above and other features of the invention will become more apparent by describing in detailed exemplary embodiments thereof with reference to the accompanying drawings, in which.

DETAILED DESCRIPTION

Figure 1:
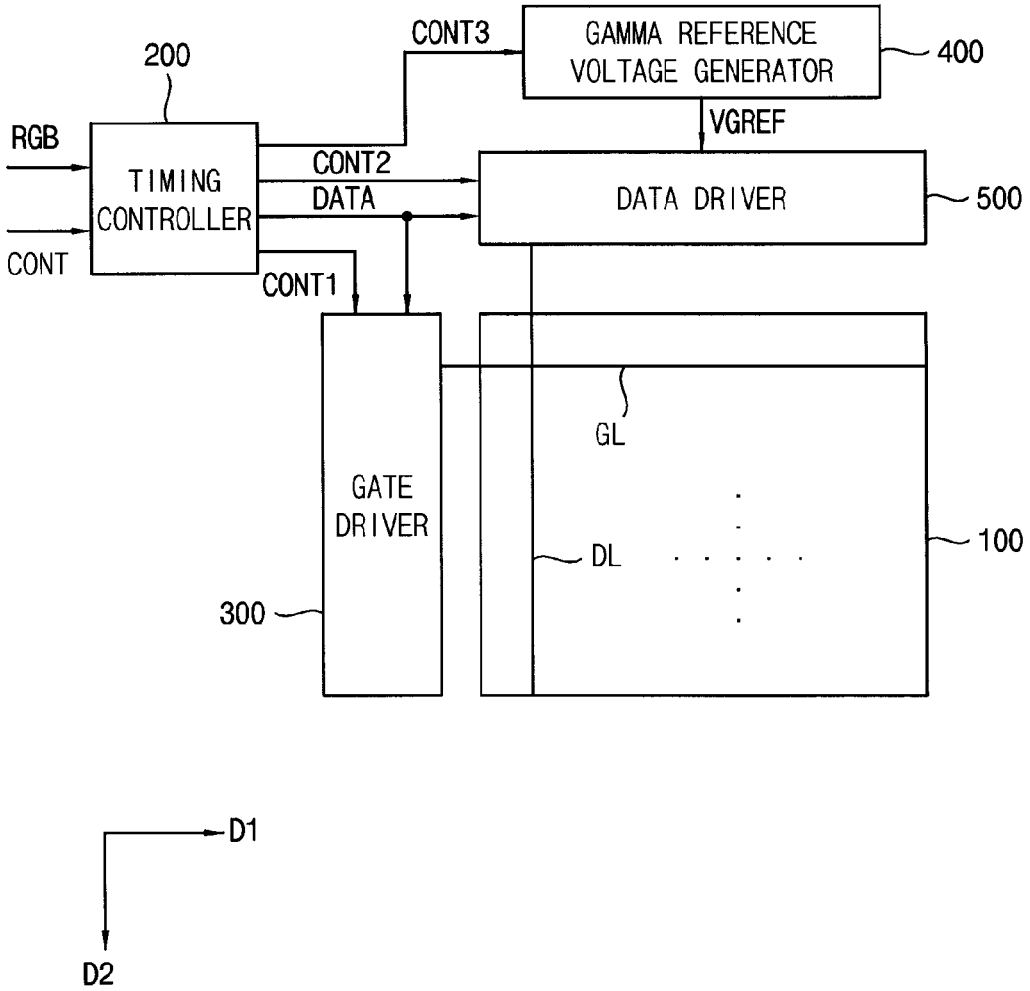
FIG. 1 is a block diagram illustrating an exemplary embodiment of a display apparatus, according to the invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims.

Hereinafter, exemplary embodiments of the invention will be described in detail with reference to the accompanying drawings.

FIG. 1 is a block diagram illustrating an exemplary embodiment of a display apparatus, according to the invention.

Referring to FIG. 1, an exemplary embodiment of the display apparatus includes a display panel 100 and a panel driver. The panel driver includes a timing controller 200, a gate driver 300, a gamma reference voltage generator 400 and a data driver 500.

The display panel 100 has a display region, on which an image is displayed, and a peripheral region adjacent to the display region.

The display panel 100 includes a plurality of gate lines GL, a plurality of data lines DL and a plurality of unit pixels connected to the gate lines GL and the data lines DL. The gate lines GL extend substantially in a first direction D1 and the data lines DL extend substantially in a second direction D2 crossing the first direction D1.

Each unit pixel includes a switching element (not shown), a liquid crystal capacitor (not shown) and a storage capacitor (not shown). The liquid crystal capacitor and the storage capacitor are electrically connected to the switching element. The unit pixels may be disposed substantially in a matrix form.

The timing controller 200 receives input image data RGB and an input control signal CONT from an external apparatus (not shown). The input image data may include red image data R, green image data G and blue image data B. The input control signal CONT may include a master clock signal and a data enable signal. The input control signal CONT may further include a vertical synchronizing signal and a horizontal synchronizing signal.

The timing controller 200 generates a first control signal CONT1, a second control signal CONT2, a third control signal CONT3 and a data signal DATA based on the input image data RGB and the input control signal CONT.

The timing controller 200 generates the first control signal CONT1 for controlling an operation of the gate driver 300 based on the input control signal CONT, and outputs the first control signal CONT1 to the gate driver 300. The first control signal CONT1 may further include a vertical start signal and a gate clock signal.

The timing controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The timing controller 200 generates the data signal DATA based on the input image data RGB. The timing controller 200 outputs the data signal DATA to the data driver 500. The timing controller 200 may also output the data signal DATA to the gate driver 300.

The timing controller 200 generates the third control signal CONT3 for controlling an operation of the gamma reference voltage generator 400 based on the input control signal CONT, and outputs the third control signal CONT3 to the gamma reference voltage generator 400.

The gate driver 300 generates gate signals driving the gate lines GL in response to the first control signal CONT1 received from the timing controller 200. The gate driver 300 sequentially outputs the gate signals to the gate lines GL.

In one exemplary embodiment, for example, the gate driver 300 may be directly mounted on the display panel 100, or may be connected to the display panel 100 as a tape carrier package ("TCP") type. Alternatively, the gate driver 300 may be integrated on the display panel 100.

A structure of the gate driver 300 will be described later in greater detail referring to FIG. 2.

The gamma reference voltage generator 400 generates a gamma reference voltage VGREF in response to the third control signal CONT3 received from the timing controller 200. The gamma reference voltage generator 400 provides the gamma reference voltage VGREF to the data driver 500. The gamma reference voltage VGREF has a value corresponding to a level of the data signal DATA.

In an exemplary embodiment, the gamma reference voltage generator 400 may be disposed in the timing controller 200, or in the data driver 500.

The data driver 500 receives the second control signal CONT2 and the data signal DATA from the timing controller 200, and receives the gamma reference voltages VGREF from the gamma reference voltage generator 400. The data driver 500 converts the data signal DATA into data voltages of analog type using the gamma reference voltages VGREF. The data driver 500 sequentially outputs the data voltages to the data lines DL.

In one exemplary embodiment, for example, the data driver 500 may be directly mounted on the display panel 100, or be connected to the display panel 100 in a TCP type. In an alternative exemplary embodiment, the data driver 500 may be integrated on the display panel 100.

Figure 2:
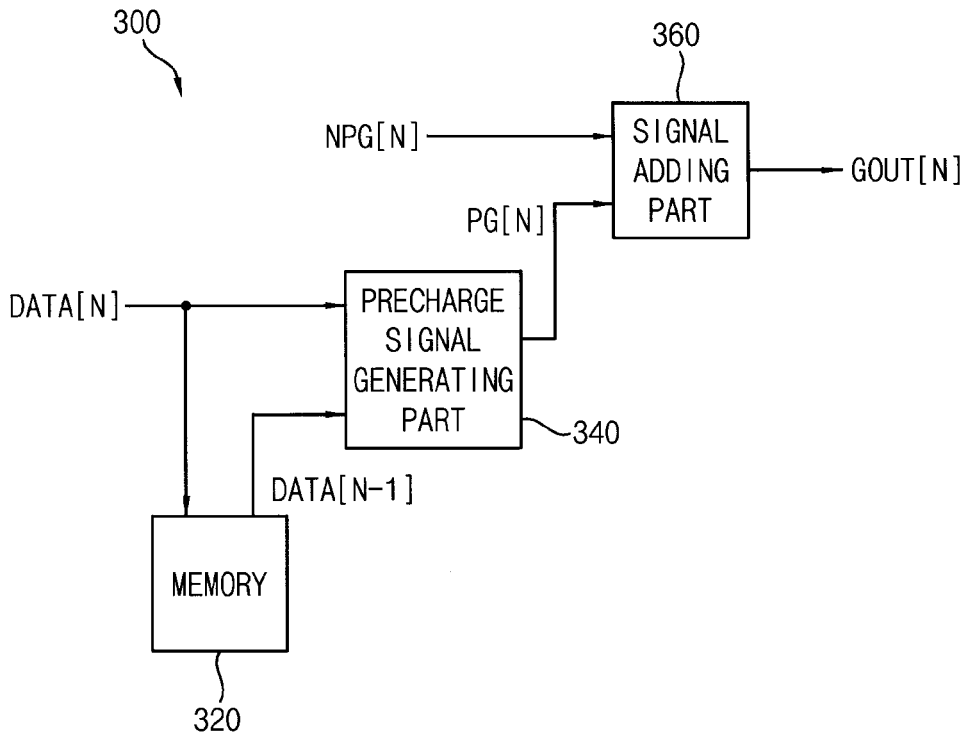
FIG. 2 is a block diagram illustrating an exemplary embodiment of a gate driver of FIG. 1.
Figure 3:
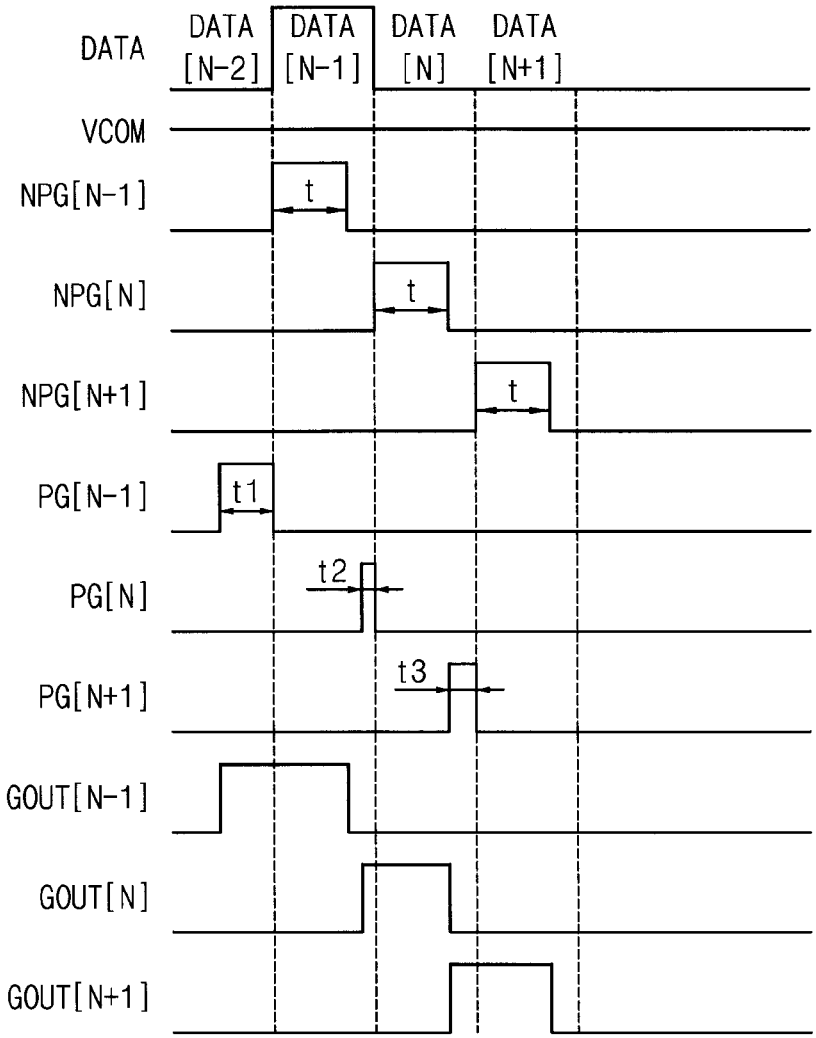
FIG. 3 is a waveform diagram illustrating input signals and output signals of an exemplary embodiment of the gate driver of FIG. 1.

FIG. 2 is a block diagram illustrating an exemplary embodiment of the gate driver 300 of FIG. 1. FIG. 3 is a waveform diagram illustrating input signals and output signals of an exemplary embodiment of the gate driver 300 of FIG. 1.

Referring to FIGS. 1 to 3, an exemplary embodiment of the gate driver 300 generates a precharge signal (e.g. an N-th precharge signal PG[N]) based on a previous data signal (e.g. an (N−1)-th data signal DATA[N−1]) corresponding to a previous gate line and a present data signal (e.g. an N-th data signal DATA[N]) corresponding to a present gate line. The gate driver 300 adds the precharge signal (e.g. an N-th precharge signal PG[N]) and a non-precharge signal (e.g. an N-th non-precharge signal NPG[N]) to generate a gate signal (e.g. an n-th gate signal GOUT[N]).

The non-precharge signal may be a gate signal when the precharge operation is not performed. A high duration of an N-th non-precharge signal NPG[N] is defined in an N-th horizontal period. Herein, N is a positive integer.

The precharge signal has a high state for a precharge driving method earlier than the non-precharge signal. A high duration of an N-th precharge signal PG[N] is not defined in the N-th horizontal period. In an exemplary embodiment, the high duration of the N-th precharge signal PG[N] may be defined in a horizontal period before the N-th horizontal period.

In an exemplary embodiment, the gate driver 300 includes a precharge signal generating part 340 (may be referred to as "precharge signal generator") and a signal adding part 360 (may be referred to as "signal adder"). The gate driver 300 may further include a memory 320.

In an exemplary embodiment, the precharge signal generating part 340 generates the precharge signal PG[N] which varies based on the previous data signal DATA[N−1] corresponding to the previous gate line and the present data signal DATA[N] corresponding to the present gate line.

In an exemplary embodiment, the present gate line may be an N-th gate line and the previous gate line may be an (N−1)-th gate line, and such a precharge driving method may be referred to as N−1 precharge driving method.

The precharge signal PG[N] may be determined by a difference between the present data signal DATA[N] and the previous data signal DATA[N−1]. In one exemplary embodiment, for example, a width of the high duration of the precharge signal PG[N] may vary based on the difference between the present data signal DATA[N] and the previous data signal DATA[N−1].

The precharge signal generating part 340 may include a precharge lookup table. The precharge lookup table may store the width of the high duration of the precharge signal PG[N] corresponding to the difference between the present data signal DATA[N] and the previous data signal DATA [N−1]. In an exemplary embodiment, the precharge lookup table may have a horizontal axis (e.g., a first row) corresponding to the present data signal and a vertical axis (e.g., a first column) corresponding to the previous data signal, and a plurality of fields corresponding to the width of the high duration of the precharge signal PG are stored at a cross point of the horizontal axis and the vertical axis in the precharge lookup table.

In such an embodiment, as the difference between a value of the present data signal DATA[N] and a value of the previous data signal DATA[N−1] increases, the width of the high duration of the precharge signal PG[N] may increase.

In an exemplary embodiment, when the present data signal DATA[N] is greater than the previous data signal DATA[N−1], the pixel may not be sufficiently charged during the N-th horizontal duration. Accordingly, in such an embodiment, the pixel may be precharged before the N-th horizontal duration.

In such an embodiment, when the value of the present data signal DATA[N] is substantially equal to the value of the previous data signal DATA[N−1], an amount of the precharge may be less than a case when the value of the present data signal DATA[N] is greater than the value of the previous data signal DATA[N−1].

In such an embodiment, when the value of the present data signal DATA[N] is less than the value of the previous data signal DATA[N−1], an amount of the precharge may be less than a case when the value of the present data signal DATA[N] is substantially equal to the value of the previous data signal DATA[N−1].

In an exemplary embodiment, as shown in FIG. 3, during an (N−1)-th horizontal duration, the value of a present data signal DATA[N−1] may be greater than the value of a previous data signal DATA[N−2]. In such an embodiment, an (N−1)-th precharge signal PG[N−1] may have a first width t1 of a high duration.

During an (N+1)-th horizontal duration, the value of a present data signal DATA[N+1] may be substantially equal to the value of a previous data signal DATA[N]. An (N+1)-th precharge signal PG[N+1] may have a third width t3 of a high duration, which is less than the width t1 of the high duration of the (N−1)-th precharge signal PG[N−1].

During an N-th horizontal duration, the value of a present data signal DATA[N] may be less than the value of a previous data signal DATA[N−1]. An N-th precharge signal PG[N] may have a second width t2 of high duration which is less than the third width t3 of the high duration of the N-th precharge signal PG[N].

In an exemplary embodiment, in the precharge lookup table, where the horizontal axis represents the present data signal and the vertical axis represents the previous data signal, all fields of the precharge lookup table may have values greater than zero.

The signal adding part 360 adds the precharge signal and the non-precharge signal to generate the gate signal.

In an exemplary embodiment, (N−1)-th to (N+1)-th non-precharge signals NPG[N−1], NPG[N] and NPG[N+1] have substantially the same width t of a high duration as each other.

An (N−1)-th gate signal GOUT[N−1] is generated by adding the (N−1)-th precharge signal PG[N−1] and the (N−1)-th non-precharge signal NPG[N−1]. The width of the high duration of the (N−1)-th gate signal GOUT[N−1] may be t1+t, where the width of a high duration of the (N−1)-th precharge signal PG[N−1] is the first width t1, as shown in FIG. 3.

An N-th gate signal GOUT[N] is generated by adding the N-th precharge signal PG[N] and the N-th non-precharge signal NPG[N]. The width of the high duration of the N-th gate signal GOUT[N] may be t2+t, where the width of a high duration of the N-th precharge signal PG[N] is the second width t2, as shown in FIG. 3.

An (N+1)-th gate signal GOUT[N+1] is generated by adding the (N+1)-th precharge signal PG[N+1] and the (N+1)-th non-precharge signal NPG[N+1]. The width of the high duration of the (N+1)-th gate signal GOUT[N+1] may be t3+t, where the width of a high duration of the (N+1)-th precharge signal PG[N+1] is the third width t3, as shown in FIG. 3.

In one exemplary embodiment, for example, the signal adding part 360 may include OR operation circuit that operates an OR operation between the precharge signal and the non-precharge signal.

The memory 320 receives the data signal DATA from the timing controller 200. The memory 320 stores the data signal DATA and outputs the data signal DATA to the precharge signal generating part 340.

The memory 320 may receive the present data signal (e.g. the N-th data signal DATA[N]) from the timing controller 200 and output the previous data signal (e.g. the (N−1)-th data signal DATA[N−1]) to the precharge signal generating part 340.

In an exemplary embodiment, the memory 320 may be disposed in the timing controller 200.

During the N-th horizontal duration, the value of the present data signal DATA[N] may be an average of gray-scale data of pixels corresponding to the N-th gate line. During the N-th horizontal duration, the value of the previous data signal DATA[N−1] may be an average of grayscale data of pixels corresponding to the (N−1)-th gate line.

During the N-th horizontal duration, the value of the present data signal DATA[N] may be an average of grayscale data of pixels corresponding to the N-th gate line. During the N-th horizontal duration, the value of the previous data signal DATA[N−1] may be an average of grayscale data of pixels corresponding to the (N−1)-th gate line.

In an exemplary embodiment, with respect to pixels connected to the same data line, the data signal corresponding to the (N−1)-th gate line may have a polarity the same as a polarity of the data signal corresponding to the N-th gate line.

In one exemplary embodiment, for example, a data signal corresponding to a first data line and the (N−1)-th gate line may have a polarity the same as a polarity of a data signal corresponding to the first data line and the N-th gate line.

In such an embodiment, the data signal corresponding to the first data line and the N-th gate line may have the polarity the same as a polarity of a data signal corresponding to the first data line and an (N+1)-th gate line.

In an exemplary embodiment, the pixels in the display panel 100 may be inverted in a column inversion method. A data signal corresponding to a second data line and the N-th gate line may have a polarity opposite to the polarity of the data signal corresponding to the first data line and the N-th gate line.

In an alternative exemplary embodiment, the pixels in the display panel 100 may be inverted every frame, and all pixels may have the same polarity in a frame.

According to an exemplary embodiment, the precharge signal varies based on the present data signal and the previous data signal such that a ghost defect due to an overcharge of a pixel may be effectively prevented. Thus, in such an embodiment, display quality of the display panel may be improved.

Figure 4:
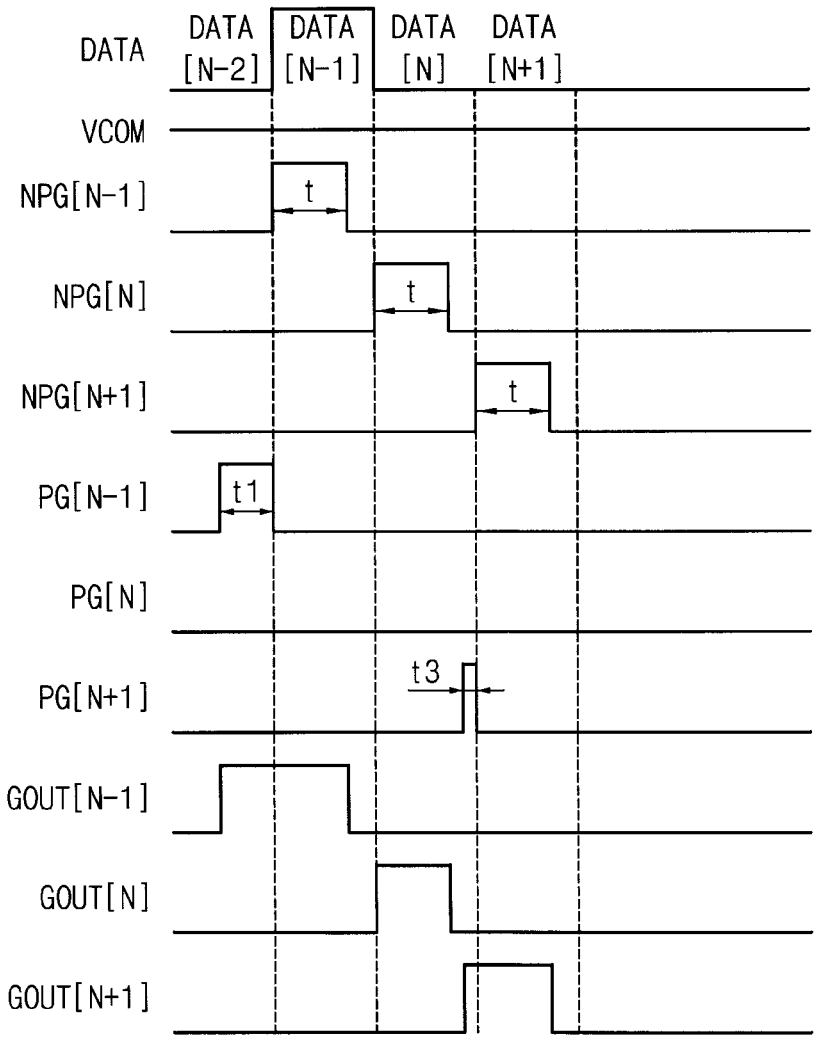
FIG. 4 is a waveform diagram illustrating input signals and output signals of an alternative exemplary embodiment of a gate driver, according to the invention.

FIG. 4 is a waveform diagram illustrating input signals and output signals of an alternative exemplary embodiment of a gate driver 300, according to the invention.

The gate driver shown in FIGS. 2 and 4 is substantially the same as the gate driver shown in FIGS. 1 to 3 except for the precharge signal. Thus, the same reference numerals will be used to refer to the same or like elements as those described in the exemplary embodiment of FIGS. 1 to 3 and any repetitive detailed description thereof will hereinafter be omitted.

Referring to FIGS. 1, 2 and 4, an alternative exemplary embodiment of the gate driver 300 includes a precharge signal generating part 340 and a signal adding part 360. The gate driver 300 may further include a memory 320.

In such an embodiment, the precharge signal generating part 340 generates the precharge signal PG[N] which varies based on the previous data signal DATA[N−1] corresponding to the previous gate line and the present data signal DATA[N] corresponding to the present gate line.

The precharge signal PG[N] may be determined by a difference between the present data signal DATA[N] and the previous data signal DATA[N−1]. In one exemplary embodiment, for example, a width of the high duration of the precharge signal PG[N] may vary based on the difference between a value of the present data signal DATA[N] and a value of the previous data signal DATA[N−1].

The precharge signal generating part 340 may include a precharge lookup table. The precharge lookup table may store the width of the high duration of the precharge signal PG[N] corresponding to the difference between the present data signal DATA[N] and the previous data signal DATA[N−1]. The precharge lookup table may have a horizontal axis corresponding to the present data signal and a vertical axis corresponding to the previous data signal, and a plurality of fields corresponding to the width of the high duration of the precharge signal are stored at a cross point of the horizontal axis and the vertical axis in the precharge lookup table.

In such an embodiment, as the difference the value of between the present data signal DATA[N] and the value of the previous data signal DATA[N−1] increases, the width of the high duration of the precharge signal PG[N] may increase.

In such an embodiment, when the present data signal DATA[N] is greater than the previous data signal DATA[N−1], the pixel may not be sufficiently charged during the N-th horizontal duration. Accordingly, in such an embodiment, the pixel may be precharged before the N-th horizontal duration.

In such an embodiment, when the value of the present data signal DATA[N] is substantially equal to the value of the previous data signal DATA[N−1], an amount of the precharge may be less than a case when the present data signal DATA[N] is greater than the previous data signal DATA[N−1].

In such an embodiment, when the present data signal DATA[N] is less than the previous data signal DATA[N−1], an amount of the precharge may be less than a case when the present data signal DATA[N] is substantially equal to the previous data signal DATA[N−1]. In an exemplary embodiment, when the present data signal DATA[N] is less than the previous data signal DATA[N−1], the precharge operation is not performed.

In an exemplary embodiment, as shown in FIG. 4, during an (N−1)-th horizontal duration, the value of a present data signal DATA[N−1] may be greater than the value of a previous data signal DATA[N−2]. In such an embodiment, an (N−1)-th precharge signal PG[N−1] may have a first width t1 of a high duration.

During an (N+1)-th horizontal duration, the value of a present data signal DATA[N+1] may be substantially equal to the value of a previous data signal DATA[N]. An (N+1)-th precharge signal PG[N+1] may have a third width t3 of a high duration, which is less than the first width t1 of the high duration of the (N−1)-th precharge signal PG[N−1].

During an N-th horizontal duration, the value of a present data signal DATA[N] may be less than the value of a previous data signal DATA[N−1], and an N-th precharge signal PG[N] may have no high duration.

In an exemplary embodiment, when the horizontal axis represents the present data signal and the vertical axis represents the previous data signal in the precharge lookup table, fields in a triangle defined at a right upper portion of the precharge lookup table may have values greater than zero. In such an embodiment, fields in a diagonal line of the precharge lookup table at which the present data signal is substantially equal to the previous data signal may have values greater than zero.

The signal adding part 360 adds the precharge signal and the non-precharge signal to generate the gate signal.

(N−1)-th to (N+1)-th non-precharge signals NPG[N−1], NPG[N] and NPG[N+1] may have substantially the same width t of a high duration as each other.

An (N−1)-th gate signal GOUT[N−1] is generated by adding the (N−1)-th precharge signal PG[N−1] and the (N−1)-th non-precharge signal NPG[N−1]. The width of the high duration of the (N−1)-th gate signal GOUT[N−1] may be t1+t, where the width of a high duration of the (N−1)-th precharge signal PG[N−1] is the first width t1, as shown in FIG. 4.

An N-th gate signal GOUT[N] is generated by adding the N-th precharge signal PG[N] and the N-th non-precharge signal NPG[N]. In an exemplary embodiment, the N-th precharge signal PG[N] does not have high duration such that the width of the high duration of the N-th gate signal GOUT[N] may be t, which is the high duration of the N-th non-precharge signal NPG[N].

An (N+1)-th gate signal GOUT[N+1] is generated by adding the (N+1)-th precharge signal PG[N+1] and the (N+1)-th non-precharge signal NPG[N+1]. The width of the high duration of the (N+1)-th gate signal GOUT[N+1] may be t3+t, where the width of a high duration of the (N+1)-th precharge signal PG[N+1] is the third width t3, as shown in FIG. 4.

According to an exemplary embodiment, the precharge signal varies based on the data signal and the previous data signal such that a ghost defect due to an overcharge of a pixel may be effectively prevented. Thus, in such an embodiment, display quality of the display panel may be improved.

Figure 5:
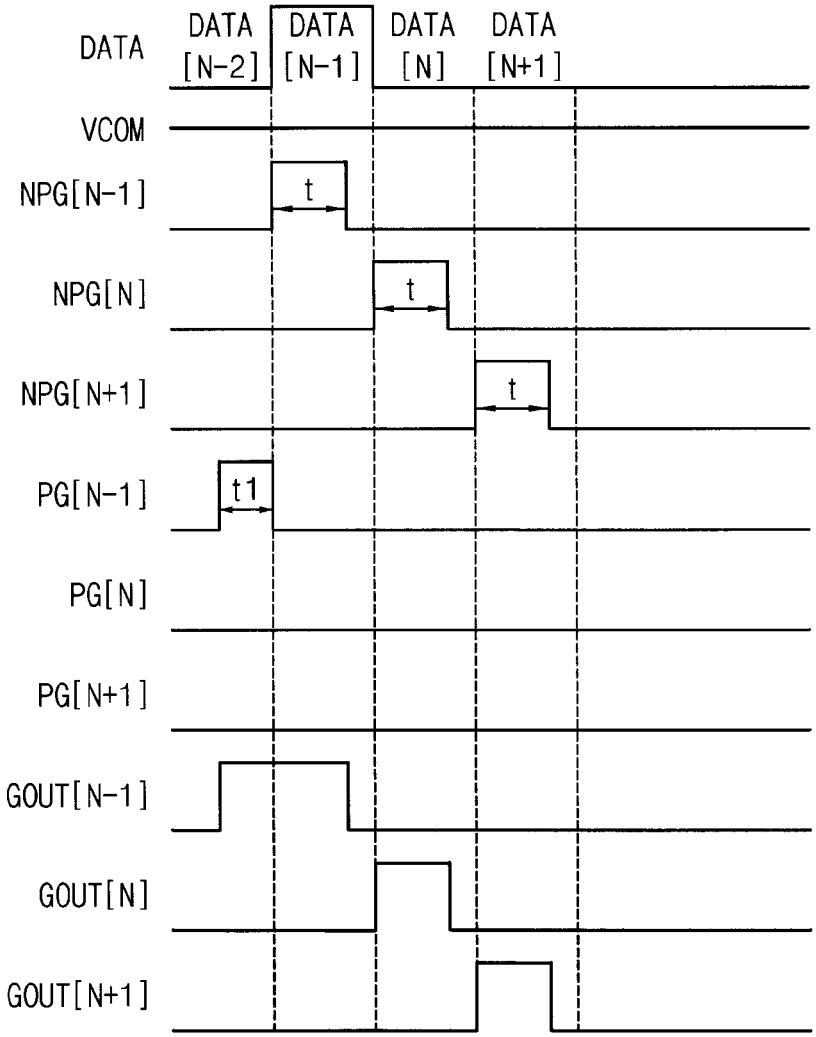
FIG. 5 is a waveform diagram illustrating input signals and output signals of another alternative exemplary embodiment of a gate driver, according to the invention.

FIG. 5 is a waveform diagram illustrating input signals and output signals of another alternative exemplary embodiment of a gate driver 300, according to the invention.

The gate driver shown in FIGS. 2 and 5 is substantially the same as the gate driver shown in FIGS. 1 to 3 except for the precharge signal. Thus, the same reference numerals will be used to refer to the same or like element as those described in the exemplary embodiment of the gate driver shown in FIGS. 1 to 3, and any repetitive detailed description thereof will hereinafter be omitted.

Referring to FIGS. 1, 2 and 5, another alternative exemplary embodiment of the gate driver 300 includes a precharge signal generating part 340 and a signal adding part 360. The gate driver 300 may further include a memory 320.

In such an embodiment, the precharge signal generating part 340 generates the precharge signal PG[N] which varies based on the previous data signal DATA[N−1] corresponding to the previous gate line and the present data signal DATA[N] corresponding to the present gate line.

In such an embodiment, the precharge signal PG[N] may be determined by a difference between the present data signal DATA[N] and the previous data signal DATA[N−1]. In one exemplary embodiment, for example, a width of the high duration of the precharge signal PG[N] may vary based on the difference between the value of the present data signal DATA[N] and the value of the previous data signal DATA[N−1].

The precharge signal generating part 340 may include a precharge lookup table. The precharge lookup table may store the width of the high duration of the precharge signal PG[N] corresponding to the difference between the value of the present data signal DATA[N] and the value of the previous data signal DATA[N−1]. The precharge lookup table may have a horizontal axis corresponding to the present data signal and a vertical axis corresponding to the previous data signal, and a plurality of fields corresponding to the width of the high duration of the precharge signal is stored at a cross point of the horizontal axis and the vertical axis in the precharge lookup table.

As the difference between the value of the present data signal DATA[N] and the value of the previous data signal DATA[N−1] increases, the width of the high duration of the precharge signal PG[N] may increase.

In one exemplary embodiment, for example, when the value of the present data signal DATA[N] is greater than the value of the previous data signal DATA[N−1], the pixel may not be sufficiently charged during the N-th horizontal duration. Accordingly, in such an embodiment, the pixel may be precharged before the N-th horizontal duration.

When the value of the present data signal DATA[N] is equal to or less than the value of the previous data signal DATA[N−1], an amount of the precharge may be less than a case when the value of the present data signal DATA[N] is greater than the value of the previous data signal DATA[N−1]. In an exemplary embodiment, when the value of the present data signal DATA[N] is equal to or less than the value of the previous data signal DATA[N−1], the precharge operation is not performed.

In an exemplary embodiment, as shown in FIG. 5, during an (N−1)-th horizontal duration, the value of a present data signal DATA[N−1] may be greater than the value of a previous data signal DATA[N−2]. In such an embodiment, an (N−1)-th precharge signal PG[N−1] may have a first width t1 of a high duration.

During an (N+1)-th horizontal duration, the value of a present data signal DATA[N+1] may be substantially equal to the value of a previous data signal DATA[N], and an (N+1)-th precharge signal PG[N+1] may have no high duration.

During an N-th horizontal duration, the value of a present data signal DATA[N] may be less than the value of a previous data signal DATA[N−1], and an N-th precharge signal PG[N] may have no high duration.

In an exemplary embodiment, when the horizontal axis represents the present data signal and the vertical axis represents the previous data signal, fields in a triangle defined at a right upper portion of the precharge lookup table may have values greater than zero. Fields in a diagonal line of the precharge lookup table, at which the present data signal is substantially equal to the previous data signal, may have a value of zero.

The signal adding part 360 adds the precharge signal and the non-precharge signal to generate the gate signal.

(N−1)-th to (N+1)-th non-precharge signals NPG[N−1], NPG[N] and NPG[N+1] may have substantially the same width t of a high duration as each other.

An (N−1)-th gate signal GOUT[N−1] is generated by adding the (N−1)-th precharge signal PG[N−1] and the (N−1)-th non-precharge signal NPG[N−1]. The width of the high duration of the (N−1)-th gate signal GOUT[N−1] may be t1+t, where the width of a high duration of the (N−1)-th precharge signal PG[N−1] is the first width t1, as shown in FIG. 5.

An N-th gate signal GOUT[N] is generated by adding the N-th precharge signal PG[N] and the N-th non-precharge signal NPG[N]. In an exemplary embodiment, the N-th precharge signal PG[N] does not have high duration such that the width of the high duration of the N-th gate signal GOUT[N] may be t, which is the high duration of the N-th non-precharge signal NPG[N].

An (N+1)-th gate signal GOUT[N+1] is generated by adding the (N+1)-th precharge signal PG[N+1] and the (N+1)-th non-precharge signal NPG[N+1]. In an exemplary embodiment, the (N+1)-th precharge signal PG[N+1] does not have high duration such that the width of the high duration of the (N+1)-th gate signal GOUT[N+1] may be t, which is the high duration of the (N+1)-th non-precharge signal NPG[N+1].

According to an exemplary embodiment, the precharge signal varies based on the present data signal and the previous data signal such that a ghost defect due to an overcharge of a pixel may be effectively prevented. Thus, in such an embodiment, display quality of the display panel may be improved.

Figure 6:
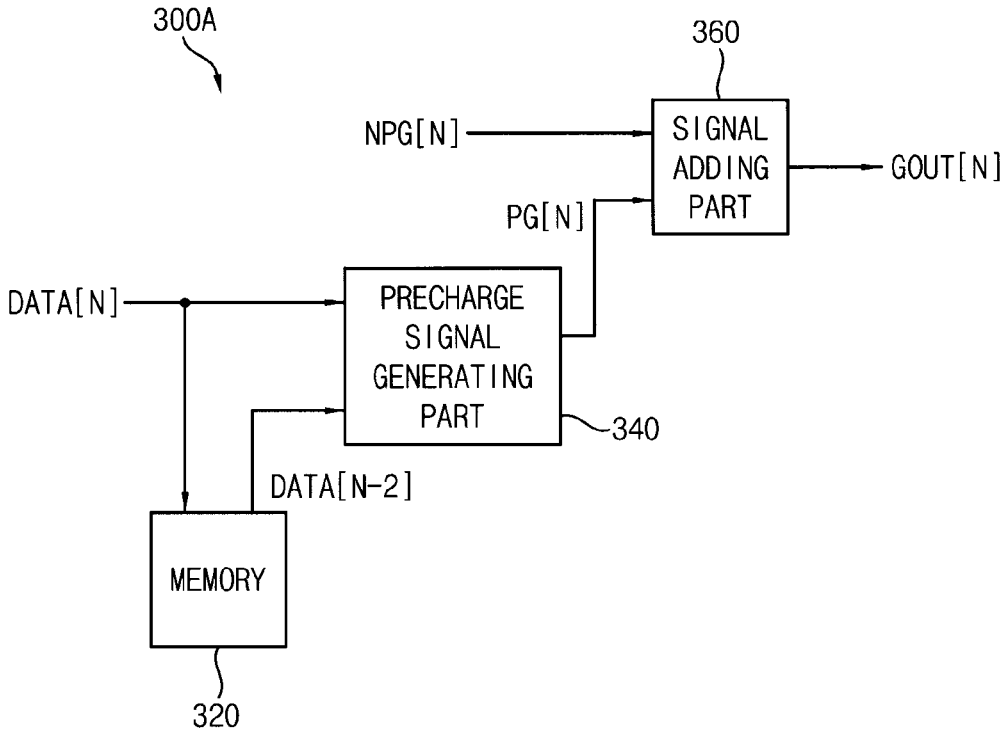
FIG. 6 is a block diagram illustrating an alternative exemplary embodiment of a gate driver, according to the invention.
Figure 7:
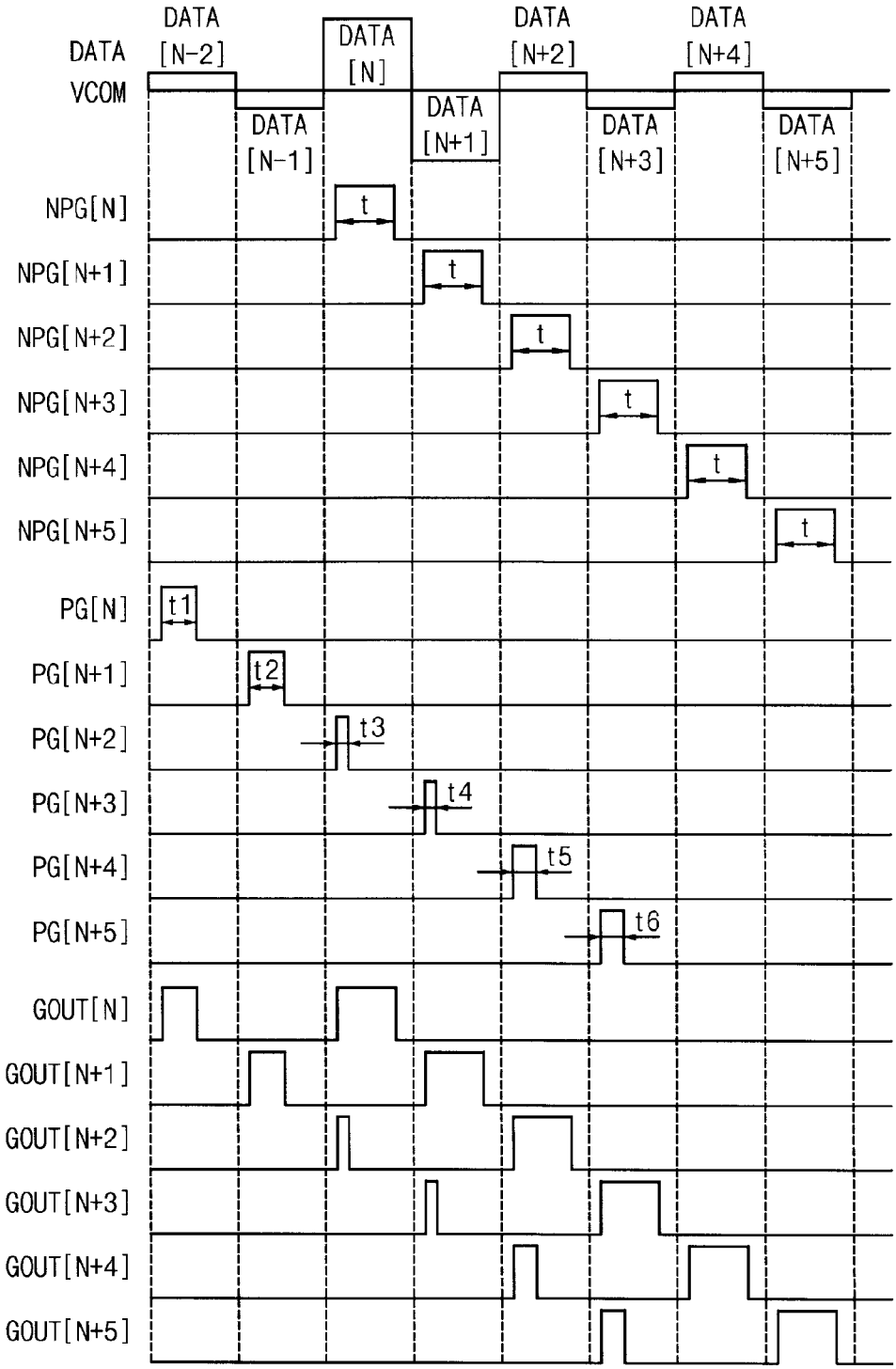
FIG. 7 is a waveform diagram illustrating input signals and output signals of an exemplary embodiment of the gate driver of FIG. 6.

FIG. 6 is a block diagram illustrating an alternative exemplary embodiment of a gate driver 300A, according to the invention. FIG. 7 is a waveform diagram illustrating input signals and output signals of an exemplary embodiment of the gate driver of FIG. 6.

The gate driver shown in FIG. 6 is substantially the same as the gate driver shown in FIGS. 1 to 3 except for the previous data signal. Thus, the same reference numerals will be used to refer to the same or like elements as those described in the exemplary embodiments of FIGS. 1 to 3, and any repetitive description thereof will hereinafter be omitted.

Referring to FIGS. 1, 6 and 7, an alternative exemplary embodiment of the gate driver 300A includes a precharge signal generating part 340 and a signal adding part 360. The gate driver 300A may further include a memory 320.

The precharge signal generating part 340 generates the precharge signal PG[N] which varies based on the previous data signal DATA[N−2] corresponding to the previous gate line and the present data signal DATA[N] corresponding to the present gate line.

In an exemplary embodiment, the gate line may be an N-th gate line and the previous gate line may be an (N−2)-th gate line, and such a precharge driving method may be referred to as N−2 precharge driving method. In an exemplary embodiment, a polarity of a data signal corresponding to the N-th gate line is the same as a polarity of a data signal corresponding to the (N−2)-th gate line. In such an embodiment, a polarity of a data signal corresponding to the N-th gate line is opposite to a polarity of a data signal corresponding to the (N−1)-th gate line. Thus, when the N-th gate signal of the N-th gate line is generated using the data signal corresponding to the (N−1)-th gate line, the precharge may not be performed for the N-th gate line.

The precharge signal PG[N] may be determined by a difference between the present data signal DATA[N] and the previous data signal DATA[N−2]. In one exemplary embodiment, for example, a width of the high duration of the precharge signal PG[N] may vary based on the difference between the value of the present data signal DATA[N] and the value of the previous data signal DATA[N−2].

As the difference between the value of the present data signal DATA[N] and the value of the previous data signal DATA[N−2] increases, the width of the high duration of the precharge signal PG[N] may increase.

In one exemplary embodiment, for example, when the value of the present data signal DATA[N] is greater than the value of the previous data signal DATA[N−2], the pixel may not be sufficiently charged during the N-th horizontal duration. Accordingly, in such an embodiment, the pixel may be precharged before the N-th horizontal duration.

When the value of the present data signal DATA[N] is substantially equal to the value of the previous data signal DATA[N−2], an amount of the precharge may be less than a case when the value of the present data signal DATA[N] is greater than the value of the previous data signal DATA [N−2].

When the value of the present data signal DATA[N] is less than the value of the previous data signal DATA[N−2], an amount of the precharge may be less than a case when the value of the present data signal DATA[N] is substantially equal to the value of the previous data signal DATA[N−2].

In an exemplary embodiment, as shown in FIG. 7, during an N-th horizontal duration, the value of a present data signal DATA[N] may be greater than the value of a previous data signal DATA[N−2]. In such an embodiment, an N-th precharge signal PG[N] may a first width t1 of a high duration.

During an (N+4)-th horizontal duration, the value of a present data signal DATA[N+4] may be substantially equal to the value of a previous data signal DATA[N+2]. In such an embodiment, an (N+4)-th precharge signal PG[N+4] may have a fifth width t5 of a high duration, which is less than the first width t1 of the high duration of the N-th precharge signal PG[N].

During an (N+2)-th horizontal duration, the value of a present data signal DATA[N+2] may be less than the value of a previous data signal DATA[N]. In such an embodiment, an (N+2)-th precharge signal PG[N+2] may have a third width t3 of high duration, which is less than the fifth width t5 of the high duration of the (N+4)-th precharge signal PG[N+4].

The signal adding part 360 adds the precharge signal and the non-precharge signal to generate the gate signal.

N-th, (N+2)-th and (N+4)-th non-precharge signals NPG [N], NPG[N+2] and NPG[N+4] may have substantially the same width t of a high duration as each other.

An N-th gate signal GOUT[N] is generated by adding the N-th precharge signal PG[N] and the N-th non-precharge signal NPG[N]. The width of the high duration of the (N−1)-th gate signal GOUT[N−1] may be t1+t, where the width of a high duration of the (N−1)-th precharge signal PG[N−1] is the first width t1, as shown in FIG. 7.

An (N+2)-th gate signal GOUT[N+2] is generated by adding the (N+2)-th precharge signal PG[N+2] and the (N+2)-th non-precharge signal NPG[N+2]. The width of the high duration of the N-th gate signal GOUT[N] may be t3+t, where the width of a high duration of the (N+1)-th precharge signal PG[N+1] is the third width t3, as shown in FIG. 7.

An (N+4)-th gate signal GOUT[N+4] is generated by adding the (N+4)-th precharge signal PG[N+4] and the (N+4)-th non-precharge signal NPG[N+4]. The width of the high duration of the (N+4)-th gate signal GOUT[N+4] may be t5+t, where the width of a high duration of the (N+4)-th precharge signal PG[N+4] is the fifth width t5, as shown in FIG. 7.

(N+1)-th, (N+3)-th and (N+5)-th gate signals GOUT[N+1], GOUT[N+3] and GOUT[N+5] are generated in the same manner as the N-th, (N+2)-th and (N+4)-th gate signals GOUT[N], GOUT[N+2] and GOUT[N+4].

In one exemplary embodiment, for example, the signal adding part 360 may include OR operation circuit operating an OR operation between the precharge signal and the non-precharge signal.

The memory 320 receives the data signal DATA from the timing controller 200. The memory 320 stores the data signal DATA and outputs the data signal DATA to the precharge signal generating part 340.

The memory 320 may receive the present data signal (e.g. the N-th data signal DATA[N]) from the timing controller 200 and output the previous data signal (e.g. the (N−2)-th data signal DATA[N−2]) to the precharge signal generating part 340.

During the N-th horizontal duration, the value of the present data signal DATA[N] may be an average of grayscale data of pixels corresponding to the N-th gate line. During the N-th horizontal duration, the value of the previous data signal DATA[N−2] may be an average of grayscale data of pixels corresponding to the (N−2)-th gate line.

During the N-th horizontal duration, the value of the present data signal DATA[N] may be an average of grayscale data of pixels corresponding to the N-th gate line. During the N-th horizontal duration, the value of the previous data signal DATA[N−2] may be an average of grayscale data of pixels corresponding to the (N−2)-th gate line.

In an exemplary embodiment, with respect to pixels connected to the same data line, the data signal corresponding to the (N−2)-th gate line may have a polarity the same as a polarity of the data signal corresponding to the N-th gate line, and the data signal corresponding to the (N−1)-th gate line may have a polarity opposite to the polarity of the data signal corresponding to the N-th gate line.

In one exemplary embodiment, for example, a data signal corresponding to a first data line and the (N−2)-th gate line may have a polarity the same as a polarity of a data signal corresponding to the first data line and the N-th gate line. In such an embodiment, a data signal corresponding to a first data line and the (N−1)-th gate line may have a polarity opposite to the polarity of the data signal corresponding to the first data line and the N-th gate line.

In an exemplary embodiment, the pixels in the display panel 100 may be inverted in a dot inversion method. In such an embodiment, a data signal corresponding to a second data line and the N-th gate line may have a polarity opposite to the polarity of the data signal corresponding to the first data line and the N-th gate line.

According to an exemplary embodiment, the precharge signal varies based on the present data signal and the previous data signal so that a ghost defect due to an overcharge of a pixel may be effectively prevented. Thus, in such an embodiment, a display quality of the display panel may be improved.

Figure 8:
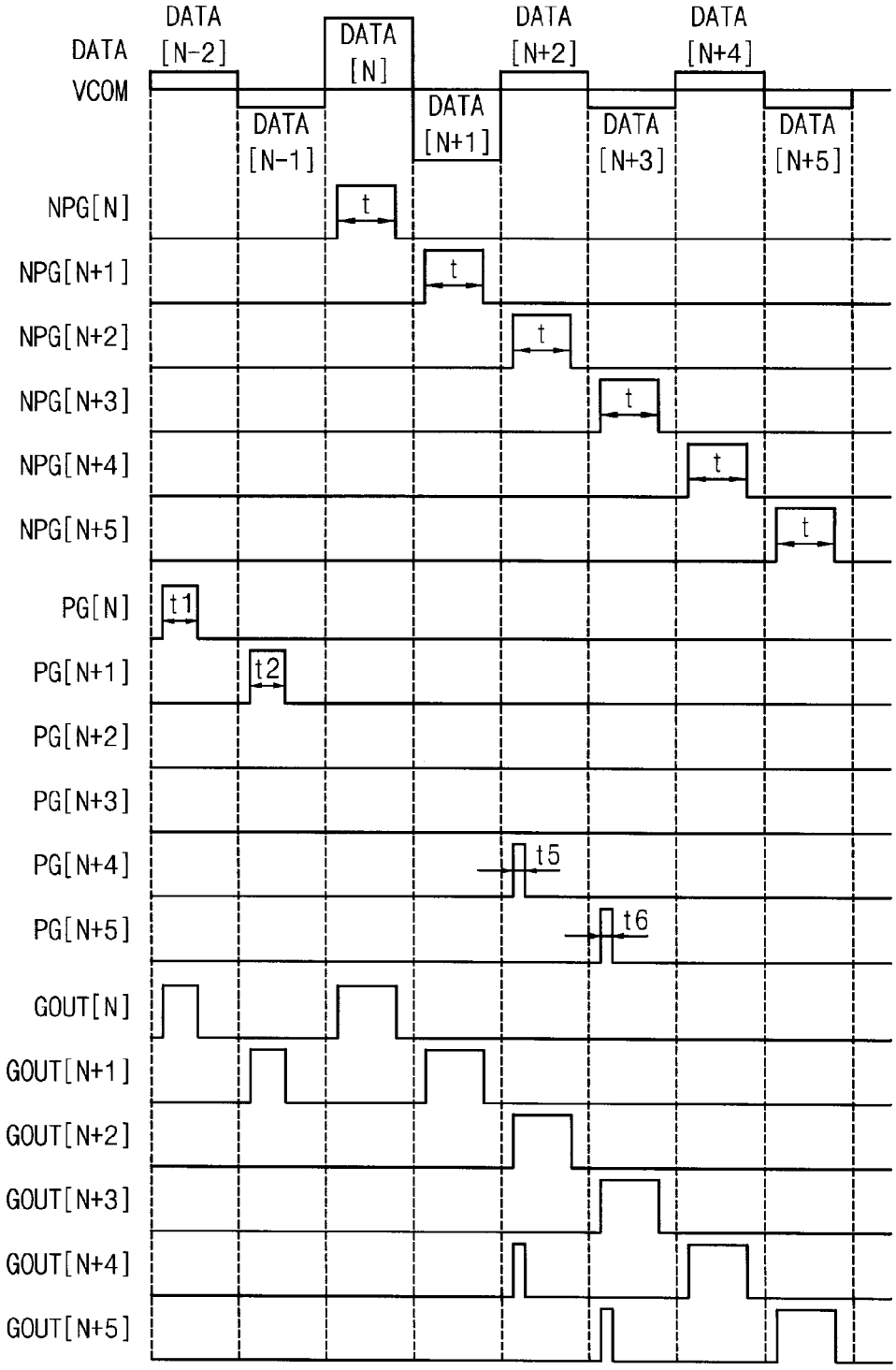
FIG. 8 is a waveform diagram illustrating input signals and output signals of an alternative exemplary embodiment of a gate driver, according to the invention.

FIG. 8 is a waveform diagram illustrating input signals and output signals of an alternative exemplary embodiment of a gate driver 300A, according to the invention.

The gate driver shown in FIGS. 6 and 8 is substantially the same as the gate driver shown in FIGS. 6 and 7 except for the precharge signal. Thus, the same reference numerals will be used to refer to the same or like elements as those described in the exemplary embodiment of FIGS. 6 and 7 and any repetitive detailed description thereof will hereinafter be omitted.

Referring to FIGS. 1, 6 and 8, an exemplary embodiment of the gate driver 300A includes a precharge signal generating part 340 and a signal adding part 360. The gate driver 300A may further include a memory 320.

In such an embodiment, the precharge signal generating part 340 generates the precharge signal PG[N] which varies based on the previous data signal DATA[N−2] corresponding to the previous gate line and the present data signal DATA[N] corresponding to the present gate line.

In an exemplary embodiment, the present gate line may be an N-th gate line and the previous gate line may be an (N−2)-th gate line.

The precharge signal PG[N] may be determined by a difference between the present data signal DATA[N] and the previous data signal DATA[N−2]. In one exemplary embodiment, for example, a width of the high duration of the precharge signal PG[N] may vary based on the difference between a value of the present data signal DATA[N] and a value of the previous data signal DATA[N−2].

In such an embodiment, as the difference between the value of the present data signal DATA[N] and the value of the previous data signal DATA[N−2] increases, the width of the high duration of the precharge signal PG[N] may increase.

In one exemplary embodiment, for example, when the value of the present data signal DATA[N] is greater than the value of the previous data signal DATA[N−2], the pixel may not be sufficiently charged during the N-th horizontal duration. Accordingly, in such an embodiment, the pixel may be precharged before the N-th horizontal duration.

When the value of the present data signal DATA[N] is substantially equal to the value of the previous data signal DATA[N−2], an amount of the precharge may be less than a case when the value of the present data signal DATA[N] is greater than the value of the previous data signal DATA [N−2].

When the value of the present data signal DATA[N] is less than the value of the previous data signal DATA[N−2], an amount of the precharge may be less than a case when the value of the present data signal DATA[N] is substantially equal to the value of the previous data signal DATA[N−2]. In an exemplary embodiment, when the value of the present data signal DATA[N] is less than the value of the previous data signal DATA[N−2], the precharge operation is not performed.

In FIG. 8, during an N-th horizontal duration, the value of a present data signal DATA[N] may be greater than the value of a previous data signal DATA[N−2]. An N-th precharge signal PG[N] may have a first width t1 of a high duration.

During an (N+4)-th horizontal duration, the value of a present data signal DATA[N+4] may be substantially equal to the value of a previous data signal DATA[N+2]. An (N+4)-th precharge signal PG[N+4] may have a fifth width t5 of a high duration which is less than the width t1 of the high duration of the N-th precharge signal PG[N].

During an (N+2)-th horizontal duration, the value of a present data signal DATA[N+2] may be less than the value of a previous data signal DATA[N]. An (N+2)-th precharge signal PG[N+2] may have no high duration.

The signal adding part 360 adds the precharge signal and the non-precharge signal to generate the gate signal.

N-th, (N+2)-th and (N+4)-th non-precharge signals NPG [N], NPG[N+2] and NPG[N+4] may have substantially the same width t of a high duration.

An N-th gate signal GOUT[N] is generated by adding the N-th precharge signal PG[N] and the N-th non-precharge signal NPG[N]. The width of the high duration of the (N−1)-th gate signal GOUT[N−1] may be t1+t, where the width of a high duration of the (N−1)-th precharge signal PG[N−1] is the first width t1, as shown in FIG. 8.

An (N+2)-th gate signal GOUT[N+2] is generated by adding the (N+2)-th precharge signal PG[N+2] and the (N+2)-th non-precharge signal NPG[N+2]. In such an embodiment, the (N+2)-th precharge signal PG[N+2] does not have high duration such that the width of the high duration of the (N+2)-th gate signal GOUT[N+2] may be t, which is the high duration of the (N+2)-th non-precharge signal NPG[N+2].

An (N+4)-th gate signal GOUT[N+4] is generated by adding the (N+4)-th precharge signal PG[N+4] and the (N+4)-th non-precharge signal NPG[N+4]. The width of the high duration of the (N+4)-th gate signal GOUT[N+4] may be t5+t, where the width of a high duration of the (N+4)-th precharge signal PG[N+4] is the fifth width t5, as shown in FIG. 8.

In such an embodiment, (N+1)-th, (N+3)-th and (N+5)-th gate signals GOUT[N+1], GOUT[N+3] and GOUT[N+5] are generated in the same manner as the N-th, (N+2)-th and (N+4)-th gate signals GOUT[N], GOUT[N+2] and GOUT [N+4].

According to an exemplary embodiment, the precharge signal varies based on the present data signal and the previous data signal such that a ghost defect due to an overcharge of a pixel may be effectively prevented. Thus, a display quality of the display panel may be improved.

Figure 9:
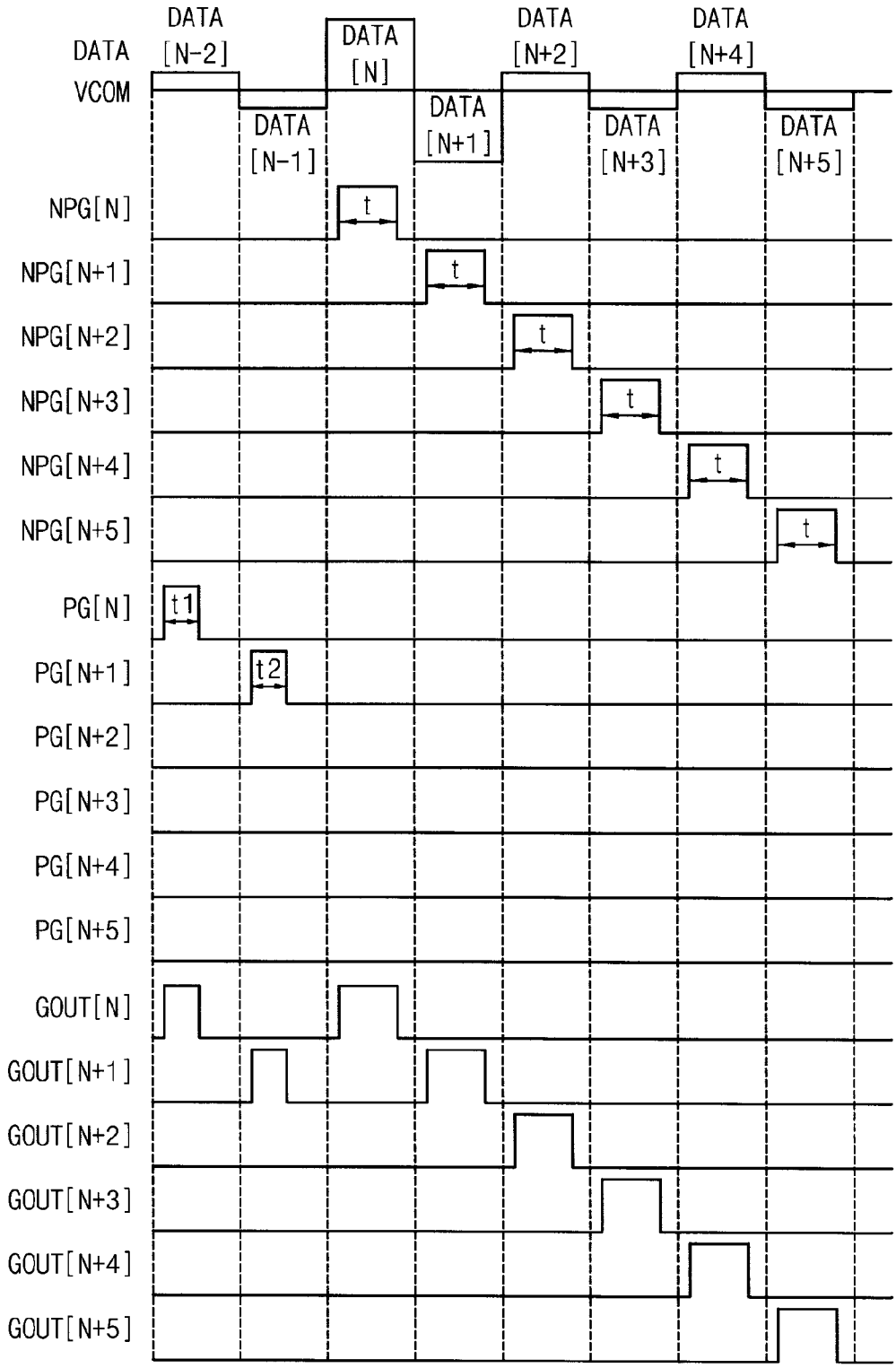
FIG. 9 is a waveform diagram illustrating input signals and output signals of another alternative exemplary embodiment of a gate driver, according to the invention.

FIG. 9 is a waveform diagram illustrating input signals and output signals of another alternative exemplary embodiment of a gate driver 300A, according to the invention.

The gate driver shown in FIGS. 6 and 9 is substantially the same as the gate driver described referring to FIGS. 6 and 7 except for the precharge signal. Thus, the same reference numerals will be used to refer to the same or like elements as those described in the exemplary embodiment of FIGS. 6 and 7, and any repetitive detailed description thereof will hereinafter be omitted.

Referring to FIGS. 1, 6 and 9, an exemplary embodiment of the gate driver 300A includes a precharge signal generating part 340 and a signal adding part 360. The gate driver 300A may further include a memory 320.

In such an embodiment, the precharge signal generating part 340 generates the precharge signal PG[N] which varies based on the previous data signal DATA[N−2] corresponding to the previous gate line and the present data signal DATA[N] corresponding to the present gate line.

In an exemplary embodiment, as shown in FIG. 9, the present gate line may be an N-th gate line and the previous gate line may be an (N−2)-th gate line.

The precharge signal PG[N] may be determined by a difference between the present data signal DATA[N] and the previous data signal DATA[N−2]. In one exemplary embodiment, for example, a width of the high duration of the precharge signal PG[N] may vary based on the difference between the value of the present data signal DATA[N] and the value of the previous data signal DATA[N−2].

As the difference between the value of the present data signal DATA[N] and the value of the previous data signal DATA[N−2] increases, the width of the high duration of the precharge signal PG[N] may increase.

In one exemplary embodiment, for example, when the value of the present data signal DATA[N] is greater than the value of the previous data signal DATA[N−2], the pixel may not be sufficiently charged during the N-th horizontal duration. Accordingly, in such an embodiment, the pixel may be precharged before the N-th horizontal duration.

When the value of the present data signal DATA[N] is equal to or less than the value of the previous data signal DATA[N−2], an amount of the precharge may be less than a case when the value of the present data signal DATA[N] is greater than the value of the previous data signal DATA [N−2]. In such an embodiment, when the value of the present data signal DATA[N] is equal to or less than the value of the previous data signal DATA[N−2], the precharge operation is not performed.

In an exemplary embodiment, as shown in FIG. 9, during an N-th horizontal duration, the value of a present data signal DATA[N] may be greater than the value of a previous data signal DATA[N−2]. An N-th precharge signal PG[N] may have a first width t1 of a high duration.

During an (N+4)-th horizontal duration, the value of a present data signal DATA[N+4] may be substantially equal to the value of a previous data signal DATA[N+2]. An (N+4)-th precharge signal PG[N+4] may have no high duration.

During an (N+2)-th horizontal duration, the value of a present data signal DATA[N+2] may be less than the value of a previous data signal DATA[N]. An (N+2)-th precharge signal PG[N+2] may have no high duration.

The signal adding part 360 adds the precharge signal PG and the non-precharge signal NPG to generate the gate signal GOUT.

N-th, (N+2)-th and (N+4)-th non-precharge signals NPG [N], NPG[N+2] and NPG[N+4] may have substantially the same width t of a high duration.

An N-th gate signal GOUT[N] is generated by adding the N-th precharge signal PG[N] and the N-th non-precharge signal NPG[N]. The width of the high duration of the (N−1)-th gate signal GOUT[N−1] may be t1+t, where the width of a high duration of the (N−1)-th precharge signal PG[N−1] is the first width t1, as shown in FIG. 9.

An (N+2)-th gate signal GOUT[N+2] is generated by adding the (N+2)-th precharge signal PG[N+2] and the (N+2)-th non-precharge signal NPG[N+2]. In an exemplary embodiment, the (N+2)-th precharge signal PG[N+2] does not have high duration such that the width of the high duration of the (N+2)-th gate signal GOUT[N+2] may be t, which is the high duration of the (N+2)-th non-precharge signal NPG[N+2].

An (N+4)-th gate signal GOUT[N+4] is generated by adding the (N+4)-th precharge signal PG[N+4] and the (N+4)-th non-precharge signal NPG[N+4]. In an exemplary embodiment, the (N+4)-th precharge signal PG[N+4] does not have high duration such that the width of the high duration of the (N+4)-th gate signal GOUT[N+4] may be t, which is the high duration of the (N+4)-th non-precharge signal NPG[N+2].

(N+1)-th, (N+3)-th and (N+5)-th gate signals GOUT[N+1], GOUT[N+3] and GOUT[N+5] are generated in the same manner as the N-th, (N+2)-th and (N+4)-th gate signals GOUT[N], GOUT[N+2] and GOUT[N+4].

According to an exemplary embodiment, the precharge signal varies based on the present data signal and the previous data signal such that a ghost defect due to an overcharge of a pixel may be effectively prevented. Thus, a display quality of the display panel may be improved.

According to exemplary embodiments of the invention as described herein, a charging rate of the pixel may be compensated by the precharge driving method and the ghost defect due to the precharge driving method may be effectively prevented such that the display quality of the display panel may be improved.

The foregoing is illustrative of the invention and is not to be construed as limiting thereof. Although a few exemplary embodiments of the invention have been described, those skilled in the art will readily appreciate that many modifications are possible in the exemplary embodiments without materially departing from the novel teachings and advantages of the invention. Accordingly, all such modifications are intended to be included within the scope of the invention as defined in the claims. In the claims, means-plus-function clauses are intended to cover the structures described herein as performing the recited function and not only structural equivalents but also equivalent structures. Therefore, it is to be understood that the foregoing is illustrative of the invention and is not to be construed as limited to the specific exemplary embodiments disclosed, and that modifications to the disclosed exemplary embodiments, as well as other exemplary embodiments, are intended to be included within the scope of the appended claims. The invention is defined by the following claims, with equivalents of the claims to be included therein.

What is claimed is:

1. A gate driver comprising:

a precharge signal generating circuit configured to generate a precharge signal which varies based on a previous data signal corresponding to a previous gate line and a present data signal corresponding to a present gate line; and a signal adding circuit configured to add the precharge signal and a non-precharge signal to generate a gate signal, wherein a width of a high duration of the precharge signal increases as a difference between a value of the present data signal and a value of the previous data signal increases.

2. The gate driver of claim 1, wherein the precharge signal has no high duration when the value of the present data signal is less than the value of the previous data signal.

3. The gate driver of claim 1, wherein the precharge signal has no high duration when the value of the present data signal is equal to or less than the value of the previous data signal.

4. The gate driver of claim 1, wherein the value of the previous data signal is an average of grayscale data of pixels corresponding to the previous gate line, and the value of the present data signal is an average of grayscale data of pixels corresponding to the present gate line.

5. The gate driver of claim 1, further comprising:

a memory configured to store the previous data signal.

6. The gate driver of claim 1, wherein the signal adding circuit is configured to operate an OR operation between the precharge signal and the non-precharge signal.

7. The gate driver of claim 1, wherein the previous data signal corresponds to an (N−1)-th gate line, the present data signal corresponds to an N-th gate line, the high duration of the precharge signal is defined in an (N−1)-th horizontal period, a high duration of the non-precharge signal is defined in an N-th horizontal period, and N is a positive integer.

8. The gate driver of claim 7, wherein a data signal corresponding to the (N−1)-th gate line has a polarity the same as a polarity of a data signal corresponding to the N-th gate line.

9. The gate driver of claim 1, wherein the previous data signal corresponds to an (N−2)-th gate line, the present data signal corresponds to an N-th gate line, the high duration of the precharge signal is defined in an (N−2)-th horizontal period, a high duration of the non-precharge signal is defined in an N-th horizontal period, and N is a positive integer.

10. The gate driver of claim 9, wherein a data signal corresponding to the (N−2)-th gate line has a polarity the same as a polarity of a data signal corresponding to the N-th gate line, and a data signal corresponding to an (N−1)-th gate line has a polarity opposite to the polarity of the data signal corresponding to the N-th gate line.

11. A display apparatus comprising:

a display panel configured to display an image;

a gate driver configured to output a gate signal to the display panel, wherein the gate driver comprises:

a precharge signal generating circuit configured to generate a precharge signal which varies based on a previous data signal corresponding to a previous gate line and a present data signal corresponding to a present gate line; and a signal adding circuit configured to add the precharge signal and a non-precharge signal to generate the gate signal; and a data driver configured to generate a data voltage and to output the data voltage to the display panel, wherein a width of a high duration of the precharge signal increases as a difference between a value of the present data signal and a value of the previous data signal increases.

12. A method of driving a display panel, the method comprising:

generating a precharge signal which varies based on a previous data signal corresponding to a previous gate line, and a present data signal corresponding to a present gate line; and adding the precharge signal and a non-precharge signal to generate a gate signal, wherein a width of a high duration of the precharge signal increases as a difference between a value of the present data signal and a value of the previous data signal increases.

* * * * *